US005950956A

United States Patent [19]

Yukitake

[11] Patent Number: 5,950,956

[45] Date of Patent: Sep. 14, 1999

[54] IGNITION COIL BANK-WINDING METHOD

[75] Inventor: Kikuo Yukitake, Tsurugashima, Japan

[73] Assignee: Toyo Denso Kabushiki Kaisha, Tokyo, Japan

[21] Appl. No.: 09/023,629

[22] Filed: Feb. 13, 1998

[30] Foreign Application Priority Data

Feb. 19, 1997 [JP] Japan ..... 9-074318

[51] Int. Cl.[6] ..... B21C 47/10

[52] U.S. Cl. ..... 242/447.1; 242/419.1; 242/479.6

[58] Field of Search ..... 242/447, 419.1, 242/419.5, 419.9, 447.1, 479.4, 479.5, 479.6, 437

[56] References Cited

U.S. PATENT DOCUMENTS

| | | | |
|---|---|---|---|
| 272,812 | 2/1883 | Wharton | 242/419.1 |
| 2,304,712 | 12/1942 | Siegenthaler | 242/479.5 |
| 3,112,895 | 12/1963 | Kinney | 242/437 |
| 3,228,616 | 1/1966 | Grosh | 242/437 |
| 3,489,629 | 1/1970 | Rechin et al. | 156/165 |
| 3,497,147 | 2/1970 | McBroom et al. | 242/445.1 |
| 4,428,540 | 1/1984 | Calcagno et al. | 242/25 R |
| 4,511,870 | 4/1985 | Caillat | 335/213 |
| 5,305,961 | 4/1994 | Errard et al. | 242/7.03 |
| 5,564,637 | 10/1996 | Berthold et al. | 242/25 R |

FOREIGN PATENT DOCUMENTS

| | | | |
|---|---|---|---|
| 60-107813 | of 1985 | Japan . | |
| 1440657 | 6/1976 | United Kingdom | 242/437 |

*Primary Examiner*—Donald P. Walsh
*Assistant Examiner*—Minh-Chau Pham
*Attorney, Agent, or Firm*—Lyon & Lyon LLP

[57] ABSTRACT

An ignition coil winding method for spirally winding an element wire in conical banks of wire turns one by one in both forward and backward directions on a coil bobbin provides in particular that the number of wire turns placed in the reverse descending spiral winding direction is larger than that placed in the forward ascending spiral winding direction, thus forming a reliable coil with no falling-down of the banks of wire turns during the winding operation.

4 Claims, 3 Drawing Sheets

IGNITION COIL BANK-WINDING METHOD

BACKGROUND OF THE INVENTION

The present invention relates to a method of winding a secondary coil of an engine igniting coil device.

Japanese laid-open patent No.60-107813 discloses a bank winding method applied for manufacturing a secondary coil of a compact engine ignition coil device having a necessary dielectric strength of the coil interlayer insulation. According to this bank winding method, an element wire being fed from a nozzle reciprocating in the coil winding direction for a distance of a specified width is suitably tensioned and wound spirally in banks of turns one by one in both forward and backward directions on the bobbin rotating by being driven by a driving shaft to which the bobbin is coaxially connected.

The conventional bank winding method, however, involves a problem that winding an element wire in layers in both directions on the coil bobbin may cause slip-down of wire turns resulting in collapse of windings.

SUMMARY OF THE INVENTION

In view of the foregoing, the present invention was made to provide an improved bank winding method of forming a secondary coil on a secondary coil bobbin for an engine igniting coil, by which an element wire being fed with a constant tension from a nozzle head reciprocally moving a specified distance at a specified pitch along the rotation axis of the coil bobbin is spirally wound in layers of wire turns one by one around coil bobbin coaxially attached to a rotating shaft on the condition that the number of wire turns placed in the reverse direction of downward bank-winding with a decreasing diameter is larger than the number of wire turns in the forward direction of upward bank-winding with an increasing diameter.

According to the present invention, the effect of making the number wire turns in the reverse downward bank-winding direction larger than that in the forward upward bank-winding direction may strengthen the foundation of banks of the wire turns on the coil bobbin enough to prevent the occurrence of collapse of wire turns during the spiral winding of the wire around the bobbin.

DESCRIPTION OF THE PREFERRED EMBODIMENTS

The preferred embodiments of the present invention will be described in detail by way of example and with reference to the accompanying drawings.

Figure 1:
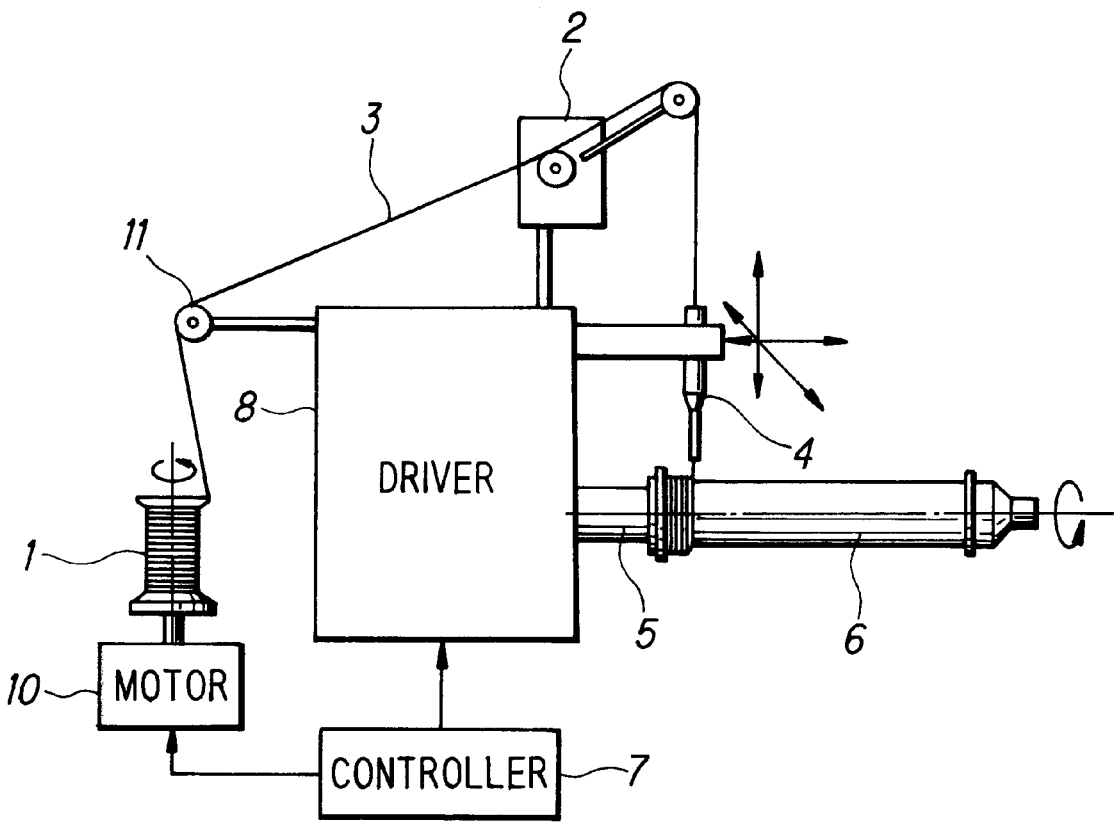
FIG. 1 is a side view of a coil winding machine for bank winding of an engine igniting coil according to the present invention.
Figure 2:
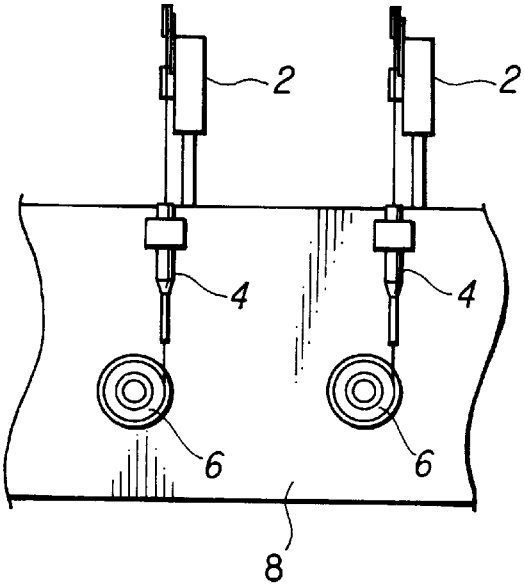
FIG. 2 is a front view of the coil winding machine of FIG. 1.
Figure 3:
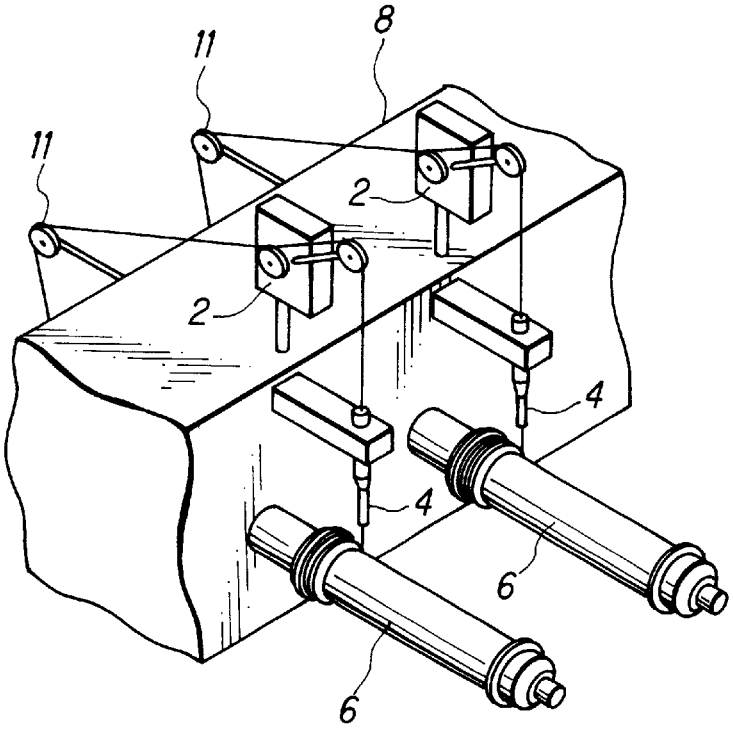
FIG. 3 is a perspective view of the coil winding machine of FIG. 1.

FIGS. 1 to 3 are illustrative of an example of coil winding machine for realizing the bank winding of an engine ignition coil by the bank winding method according to the present invention. The shown machine is of multi-unit type that is capable of simultaneously forming a plurality of engine ignition coils.

The operation of each coil winding unit of the machine is as follows:

An element wire 3 being fed from a spool 1 through a tensioning device 2 and a nozzle 4 reciprocating in the coil winding direction for a distance of a specified width is spirally wound in conical banks of turns one by one in both forward and reverse directions on a rotating coil bobbin 6 coaxially attached to a rotating shaft 5 of a driving portion which is driven by a driver 8 under the control of a controller 7.

Figure 4:
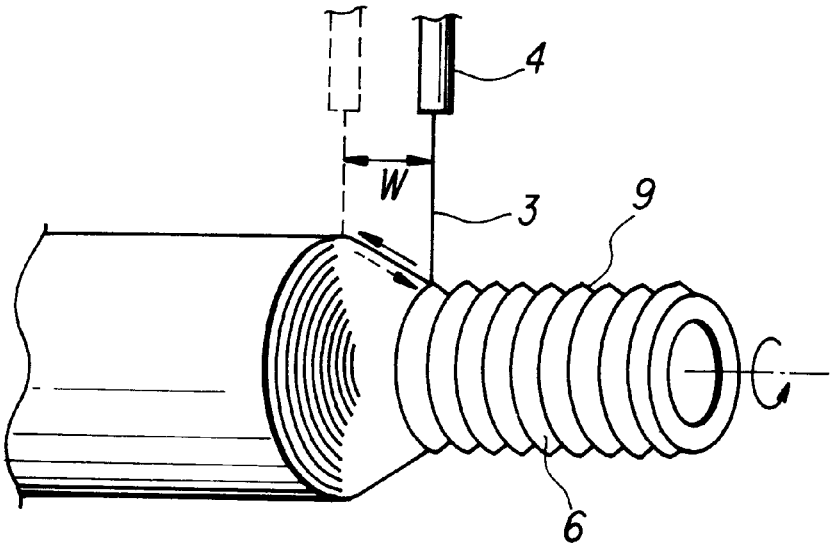
FIG. 4 is a perspective view for explaining a method of bank winding of a coil according to the present invention.

FIG. 4 shows the coil forming process in which an element wire 3 is wound in conical banks of wire turns one by one around a coil bobbin 6 in the forward direction of upward slope bank-winding with an increasing winding diameter and the reverse direction of downward slope bank-winding with a decreasing winding diameter by driving a nozzle 4 to reciprocally move a specified distance of width "w" corresponding to a bank length at a specified pitch corresponding to a diameter of the element wire 3.

The bobbin 6 has a plurality of fine grooves 9 formed in an axial direction on its body for preventing collapse of banks of wire turns.

Figure 5:
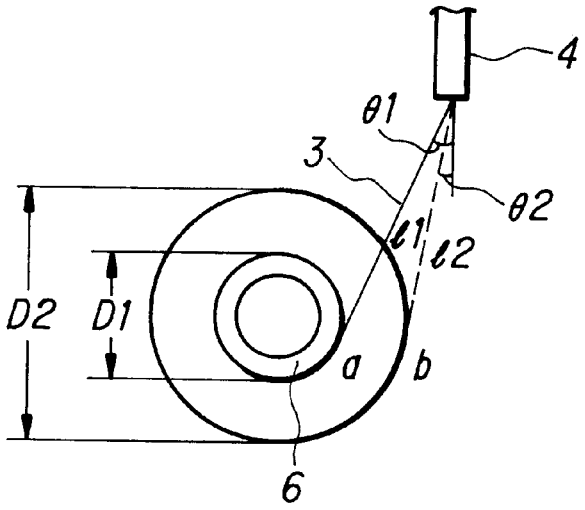
FIG. 5 is an end view for explaining a method of bank winding of a coil according to the present invention.

As shown in FIG. 5, a coil being formed on a coil bobbin 6 by spirally winding thereon an element wire 3 varies its diameter from a least diameter D1 to a maximum diameter D2, whereby the element wire 3 may have different lengths l1 and l2 (distances from a nozzle 4 to wire bending points "a" and "b" on the bank-winding section) and different angles θ1 and θ2 formed by the element wire 3 with the axis of the nozzle 4 at the least winding diameter D1 and the maximum winding diameter D2 respectively.

Consequently, the bank winding of an element wire around the coil bobbin by the nozzle 4 reciprocating only along the longitudinal axis of the bobbin is accompanied by variation of the nozzle-to-bobbin distance l and the wire-to-nozzle angle θ. This causes the element wire to vary its tension, resulting in loosening and/or falling-down of wire turns of the coil formed.

Accordingly, the method according to the present invention includes vertically moving the nozzle 4 toward and away from the coil bobbin in synchronism with winding of the element wire around the bobbin under the control of the controller 7 so that the distance l from the nozzle 4 to the wire bending point may be maintained always at a constant value.

The nozzle 4 also swings from left to right and the reverse in synchronism with winding of the element wire around the bobbin under the control of the controller 7 so that the angle θ of the element wire to the nozzle axis may be maintained always at a constant value.

The nozzle 4 can move vertically and transversely to always maintain the constant distance l and the constant angle θ of the element wire, thus assuring feeding the element wire 3 with a constant tension. This can effectively prevent the loosening wire turns and/or falling-down of the banks in the coil on the bobbin.

Usually, an element wire 3 is coated with oil to be smoothly fed from the spool 1 by the effect of a drawing force from the winding side. The winding method according to the present invention is intended to use a not-oil-coated element wire 3 to prevent the collapse of banks resulting from slip-down of wire turns therein during the process of spirally winding the wire around the bobbin.

To smoothly feed the not-oil-coated element wire 3, the spool 1 is provided with a motor 10 for rotating the spool 1 in synchronism with the winding the element wire around the bobbin under the control of the controller 7.

A cushion roller 11 is provided between the spool 1 and the tensioning device 2 to absorb the shock that may be produced when drawing the element wire 3 from the spool 1.

The combination of the rotatable spool 1 with the cushion roller 11 allows the element wire 3 to be fed always with constant tension, making it possible to form a coil on the bobbin by bank winding with no loosening of wire turns and/or no collapse of the banks of the wire turns.

The described embodiment according to the present invention is featured in particular by the fact that the process of spirally winding an element wire 3 in layers one by one in both forwarding and reverse directions provides that the number of wire turns in banks in the reverse direction of descending spiral winding with a decreasing diameter is larger than that in the forward direction of ascending spiral winding with an increasing diameter.

Namely, a coil may be formed on the coil bobbin by placing thereon, for example, 50 turns of the element wire in conical banks in the forward winding direction and 53 to 58 turns of the wire in conical banks in the reverse winding direction.

This method can form a reliable foundation of a bank slope by placing a larger number of turns on the coil bobbin in the reverse descending winding direction and by further spiral winding the wire over the upward slope of firmly wound banks, thus preventing the occurrence of falling-down of the wire turns during the winding operation.

This design solution in combination with the before described means for maintaining a constant tension in the element wire to be wound on the bobbin has an increased effect to prevent collapse of the conical banks of wire turns.

As shown in FIG. 4, the bobbin is provided with a plurality of fine grooves in which an excess of wire turns are accommodated to effectively prevent collapse of the banks of wire turns during the coil forming process.

As is apparent from the foregoing, the ignition coil winding method according to the present invention can form a reliable coil on a coil bobbin by winding an element wire spirally in conical layers one by one in both forward and reverse directions on the coil bobbin with no fear of occurrence of falling-down of the banks of wire turns. The method is featured by the fact that the number of wire turns in the reverse direction of descending spiral winding with a decreasing winding diameter is larger than that in the forward direction of ascending spiral winding with an increasing winding diameter. This method can form a reliable foundation of a bank slope by placing a larger number of turns on the coil bobbin in the reverse descending winding direction and by further spiral winding the wire over the ascending slope of firmly wound banks, thus preventing the occurrence of falling-down of the wire turns during the winding operation.

What is claimed is:

1. A method of bank winding of an engine igniting coil, by which an element wire with a specified tensioning force is fed from a nozzle reciprocating a predetermined distance at a predetermined pitch along a longitudinal axis of a coil bobbin and wound spirally in layers of wire turns one over another in both forward and reverse directions on the coil bobbin coaxially attached to a rotating shaft, wherein the number of wire turns in the reverse direction of bank winding of the element wire with a gradually decreasing winding diameter is larger than the number of wire turns in the forward direction of bank winding of the element wire with a gradually increasing winding diameter.

2. A method of bank winding of an engine igniting coil as defined in claim 1, characterized in that the coil bobbin has a number of grooves formed thereon in a longitudinal direction for accommodating the increased number of wire turns in the reverse direction.

3. A method of bank winding of an engine igniting coil, comprising the steps of tensioning an element wire and feeding the element wire through a nozzle and onto a rotating coil bobbin, reciprocating the nozzle for a predetermined distance at a predetermined pitch along a longitudinal axis of a coil bobbin for spirally winding conical layers of wire turns one over another in both forward and reverse directions on the coil bobbin, wherein the predetermined pitch of the reciprocal movement of the nozzle is smaller in the reverse direction of bank winding direction in which the conical layer is decreasing in diameter for causing the number of wire turns in the reverse direction of bank winding of the element wire with a gradually decreasing winding diameter to be larger than the number of wire turns in the forward direction of bank winding of the element wire with a gradually increasing winding diameter.

4. A method of bank winding of an engine igniting coil as defined in claim 3, characterized in that the coil bobbin has a number of grooves formed thereon in a longitudinal direction for accommodating the increased number of wire turns in the reverse direction.

* * * * *